United States Patent [19]

Yamato et al.

[11] Patent Number: 4,471,739

[45] Date of Patent: Sep. 18, 1984

[54] FUEL INJECTION CONTROL METHOD FOR A MULTI-CYLINDER INTERNAL COMBUSTION ENGINE, HAVING A FAIL SAFE FUNCTION FOR ABNORMALITY IN CYLINDER-DISCRIMINATING MEANS

[75] Inventors: Akihiro Yamato; Yutaka Otobe, both of Shiki, Japan

[73] Assignee: Honda Giken Kogyo Kabushiki Kaisha, Tokyo, Japan

[21] Appl. No.: 521,245

[22] Filed: Aug. 8, 1983

[30] Foreign Application Priority Data

Aug. 13, 1982 [JP] Japan ..... 57-140764

[51] Int. Cl.[3] ..... F02B 3/00

[52] U.S. Cl. ..... 123/479; 123/490

[58] Field of Search ..... 123/479, 490

[56] References Cited

U.S. PATENT DOCUMENTS

| | | | |
|---|---|---|---|
| 3,834,361 | 10/1974 | Keely | 123/479 |
| 4,245,315 | 1/1981 | Barman | 123/479 |
| 4,255,789 | 3/1981 | Hartford | 123/479 |
| 4,370,962 | 2/1983 | Hosaka | 123/479 |

FOREIGN PATENT DOCUMENTS

| | | | |
|---|---|---|---|
| 2072883 | 10/1981 | United Kingdom | 123/479 |

*Primary Examiner*—Ronald B. Cox

*Attorney, Agent, or Firm*—Lyon & Lyon

[57] ABSTRACT

A fuel injection control method for successively injecting fuel into a plurality of cylinders of an internal combustion engine in predetermined sequence in synchronism with pulses from top-dead-center detecting means which are successively generated immediately after generation of each pulse from cylinder-discriminating means. The method is adapted to perform a fail safe function in the event of occurrence of an abnormality in the cylinder-discriminating means. The number of pulses is counted which are successively generated from the top-dead-center detecting means immediately after generation of each pulse from the cylinder-discriminating means. If no further pulse from the cylinder-discriminating means is detected until the count of pulses from the top-dead-center detecting means reaches a number equal to the sum of the number of the engine cylinders and while the rotational speed of the engine is higher than a predetermined value, the cylinder-discriminating means is regarded as abnormal. Then, injection of fuel into the cylinders is effected in the above predetermined sequence in synchronism with pulses from the top-dead-center detecting means alone, irrespective of generation of subsequent pulses from the cylinder-discriminating means.

1 Claim, 4 Drawing Figures

FUEL INJECTION CONTROL METHOD FOR A MULTI-CYLINDER INTERNAL COMBUSTION ENGINE, HAVING A FAIL SAFE FUNCTION FOR ABNORMALITY IN CYLINDER-DISCRIMINATING MEANS

BACKGROUND OF THE INVENTION

This invention relates to a fuel injection control method for supplying fuel through injection to a plurality of cylinders of an internal combustion engine, and more particularly to a method of this kind, which is adapted to perform a fail safe function in the event of occurrence of an abnormality in cylinder-discriminating means which determines the sequence of injection of fuel into the cylinders of the engine.

Among fuel supply control methods for electronically controlling the valve opening period of a fuel metering device of an internal combustion engine, for control of the quantity of fuel being supplied to the engine, a method has been proposed, e.g. by the assignee of the present application in Japanese Provisional Patent Publication (Kokai) No. 57-137633, which is adapted to first determine a basic value of the above valve opening period, i.e. the fuel supply quantity, as a function of engine rpm and intake pipe absolute pressure and then correct the basic value thus determined by adding to and/or multiplying same by constants and/or coefficients being functions of parameters indicative of operating conditions of the engine such as engine coolant temperature, throttle valve opening, exhaust gas ingredient concentration (oxygen concentration), etc., while at the same time determining the timing of fuel injection into individual ones of the engine cylinders, from pulses of a top-dead-center signal generated at predetermined crank angle positions of pistons within the individual engine cylinders, as well as from pulses of a cylinder-discriminating signal indicative of a predetermined crank angle position of a piston within a particular engine cylinder, and drive fuel injection valves of the fuel metering device in accordance with the corrected fuel supply quantity and the determined fuel injection timing.

In such fuel injection control method, it is essential that pulses of the cylinder-discriminating signal which controls the timing of fuel injection into the engine cylinders as well as pulses of the top-dead-center signal should be generated accurately in predetermined sequence, to ensure smooth operation of the engine. The top-dead-center signal is generated by top-dead-center detecting means, pulses of which are each indicative of a predetermined position of a piston within a corresponding engine cylinder with respect to the top dead center of the same cylinder, while the cylinder-discriminating signal is generated by cylinder-discriminating means, pulses of which are each generated each time the crankshaft of the engine rotates through a predetermined angle with respect to a predetermined position of a piston within a particular engine cylinder. While the top-dead-center detecting means and the cylinder-discriminating means are both normally operating, a first one of a plurality of engine cylinders, e.g. four engine cylinders in the case of a four-cylinder engine, is supplied with injected fuel upon generation of a pulse of the top-dead-center signal generated immediately after generation of each pulse of the cylinder-discriminating signal, and the third, fourth and second cylinders of the four-cylinder engine are successively supplied with injected fuel in the mentioned sequence, in synchronism with the succeeding pulses of the top-dead-center signal. Thereafter, in the same manner as above, as further pulses of the cylinder-discriminating signal are generated, the engine cylinders are successively supplied with injected fuel in the above predetermined sequence in synchronism with successive pulses of the top-dead-center signal generated immediately after the respective preceding pulses of the cylinder-discriminating signal.

However, in the event that an abnormality occurs in the cylinder-discriminating means, such as disconnection of the wiring system, it is very likely that there is no generation of any pulse of the cylinder-discriminating signal or a pulse of the same signal is not generated through each predetermined angle of rotation of the crankshaft of the engine, that is, pulses of the same signal are generated at irregular intervals. In such event, it is impossible to attain the proper sequence of successive fuel injections into the engine cylinders in synchronism with pulses of the top-dead-center signal, which depends upon generation of pulses of the cylinder-discriminating signal. This results in the difficulty or impossibility of continuing smooth operation of the engine or degradation of the driveability of the engine, and can even result in stall of the engine.

SUMMARY OF THE INVENTION

It is the object of the invention to provide a fuel injection control method for a multi-cylinder internal combustion engine, which is adapted to perform a fail safe function to cope with occurrence of an abnormality in the cylinder-discriminating means so as to at least ensure continued operation of the engine, irrespective of irregular generation of pulses of the cylinder-discriminating signal from the cylinder-discriminating means.

According to the invention, there is provided a method for controlling the injection of fuel into an internal combustion engine having a plurality of cylinders, top-dead-center detecting means for detecting predetermined positions of pistons within respective ones of the cylinders relative to top dead centers thereof and generating pulses indicative of detected predetermined positions of the pistons, and cylinder-discriminating means adapted to generate a pulse each time the crankshaft of the engine rotates through a predetermined angle with respect to a predetermined position of a piston within a particular one of the cylinders, wherein fuel is injected into the cylinders of the engine successively in predetermined sequence in synchronism with pulses successively generated from the above top-dead-center detecting means immediately after generation of each pulse of the above cylinder-discriminating means. The method according to the invention is adapted to perform a fail safe function in the event of occurrence of an abnormality in the cylinder-discriminating means, which is characterized by the following steps: (1) detecting pulses generated from the cylinder-discriminating means; (2) counting the number of pulses successively generated from the top-dead-center detecting means immediately after generation of each pulse from the cylinder-discriminating means; (3) detecting the rotational speed of the engine; (4) regarding the cylinder-discriminating means as abnormal when no further pulse from the cylinder-discriminating means is detected after detection of each pulse generated from the cylinder-discriminating means until the counted number of pulses from the top-dead-center detecting means reaches a number equal to the sum of the number of the engine cylinders and 1 while the rotational speed of the engine is higher than a predetermined value; and (5) effecting injection of fuel into the cylinders in the above predetermined sequence in synchronism with pulses generated from the top-dead-center detecting means alone, irrespective of generation of subsequent pulses from the cylinder-discriminating means, when said cylinder-discriminating means is regarded as abnormal in the step (4).

The above and other objects, features and advantages of the invention will be more apparent from the ensuing detailed description taken in conjunction with the accompanying drawings.

DETAILED DESCRIPTION

The method according to the invention will now be described in detail with reference to the drawings.

Figure 1:
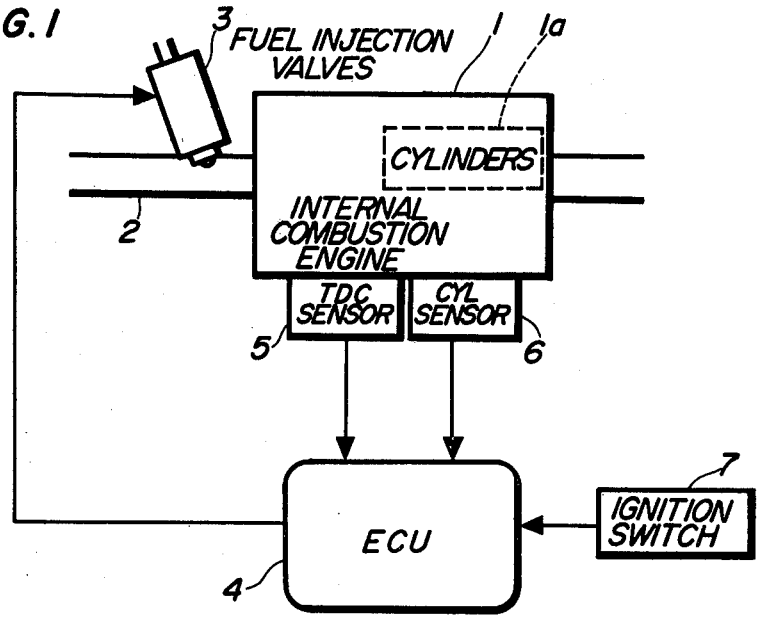
FIG. 1 is a block diagram of the arrangement of a fuel supply control system to which is applied the method according to the invention.

Referring first to FIG. 1, there is schematically illustrated the arrangement of a fuel supply control system to which is applied the method according to the invention. Reference numeral 1 designates an internal combustion engine which is a multi-cylinder type, for instance, provided with four cylinders 1*a*, to which is connected an intake manifold 2. Fuel injection valves 3 are arranged in the divergent portions of the intake manifold 2 at locations slightly upstream of intake valves, not shown, for injecting fuel into respective ones of the cylinders 1*a*. The fuel injection valves 3 are connected to a fuel pump, not shown, and also electrically connected to an electronic control unit (hereinafter called "the ECU") 4 to have their valve opening periods controlled by driving signals generated from the ECU 4.

Figure 2:
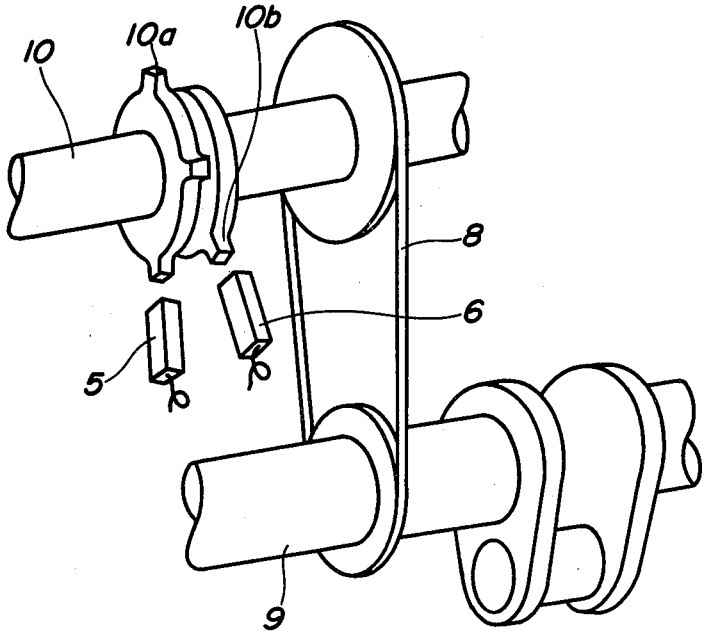
FIG. 2 is a schematic perspective view of top-dead-center detecting means (TDC sensor) and cylinder-discriminating means (CYL sensor), both appearing in FIG. 1.

A top-dead-center sensor (hereinafter called "the TDC sensor") 5 and a cylinder-discriminating sensor (hereinafter called "the CYL sensor") 6 are electrically connected to the ECU 4 for supplying their output signals thereto. As shown in FIG. 2, these sensors 5, 6 are each composed of electromagnetic pickups arranged, respectively, in facing relation to four protuberances 10*a* corresponding in number to the cylinders 1*a* and a single protuberance 10*b* formed integrally on respective magnetic discs secured on a camshaft 10 of the engine 1, which is arranged to be rotatively driven by a crankshaft 9 of the same engine with a reduction ratio of 1:2, via a timing belt 8. The TDC sensor 5 is adapted to generate a pulse indicative of a predetermined position of a piston in each of different cylinders 1*a* of the engine relative to a top dead center of the piston, that is, one pulse at a particular crank angle each time the engine crankshaft 9 rotates through 180 degrees, while the cylinder-discriminating sensor 6 is adapted to generate one pulse each time the crankshaft of the engine rotates through a predetermined angle with respect to a predetermined position of a piston in a particular cylinder. The above pulses generated by the sensors 5, 6 are supplied to the ECU 4.

Further connected to the ECU 4 is an ignition switch 7 for turning on and off an ignition device, not shown, provided in the engine, and supplying a signal indicative of on-off positions of the ignition switch 7 to the ECU 4.

Figure 3:
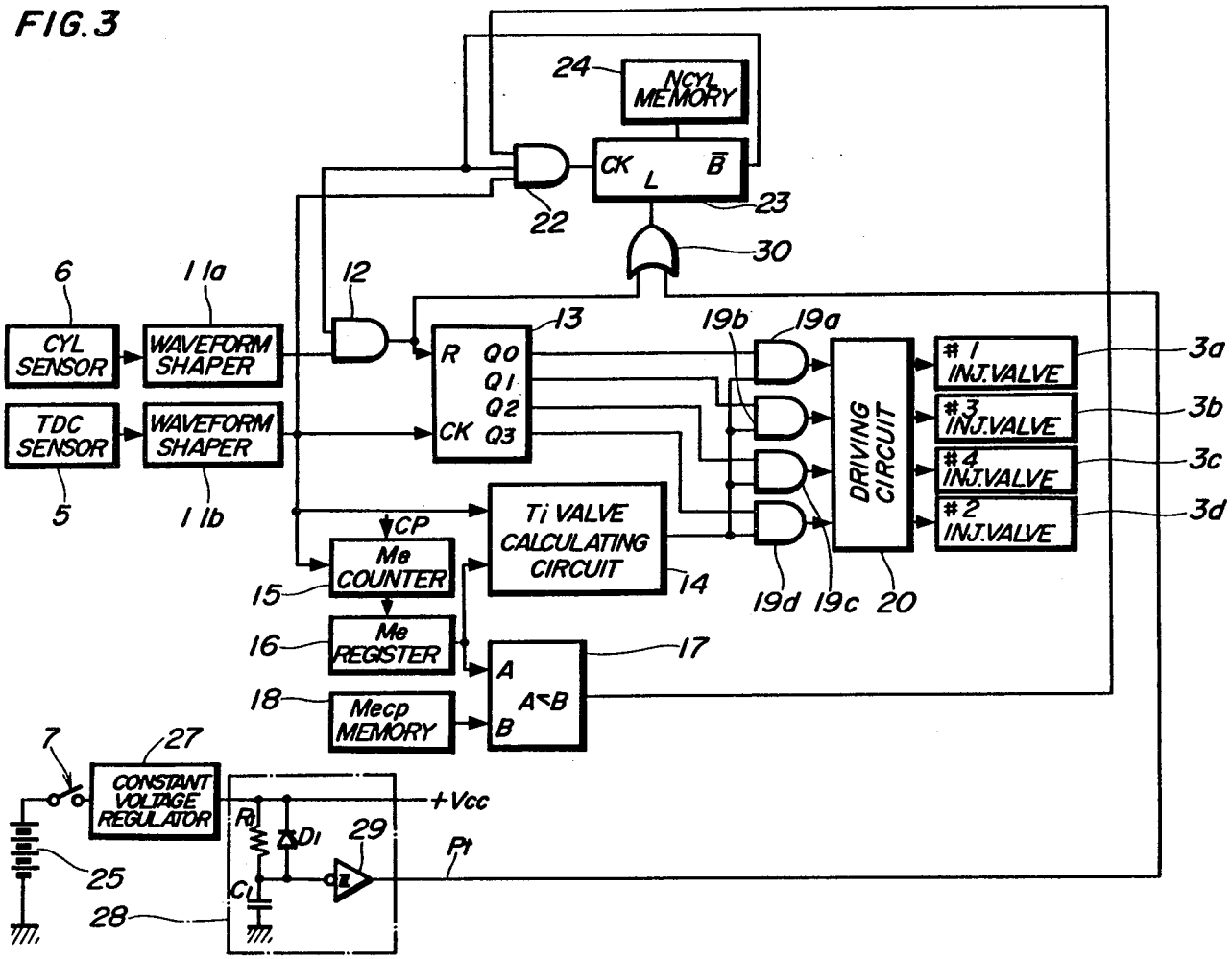
FIG. 3 is a circuit diagram of the internal arrangement of an electronic control unit (ECU) appearing in FIG. 1.

FIG. 3 shows a circuit configuration within the ECU 4 in FIG. 1. A cylinder-discriminating signal (hereinafter called "the CYL signal") generated from the CYL sensor 6 in FIG. 1 has its pulses subjected to waveform shaping into pulses having a rectangular waveform by a waveform shaper 11*a*, and then applied to an AND circuit 12. A top-dead-center signal (hereinafter called "the TDC signal") generated from the TDC sensor 5 in FIG. 1 has its pulses subjected to waveform shaping into pulses having a rectangular waveform by a waveform shaper 11*b*, and applied to an AND circuit 22, a ring counter 13 at its clock input terminal CK, a Ti value calculating circuit 14 which determines the fuel injection period Ti, and an Me value counter 15. The AND circuits 12, 22 are also supplied with an output signal from a presettable down counter 23 through its output terminal B, and an output from the AND circuit 12 is applied to the ring counter 13 at its reset pulse input terminal R as well as to the down counter 23 at its input terminal L by way of an OR circuit 30. The ring counter 13 has four output terminals Q0–Q3, outputs through which successively turn into a high level (hereinafter merely called "1") each time a pulse of the TDC signal is applied to the clock input terminal CK of the same counter 13. The ring counter 13 is reset each time a pulse of the CYL signal is applied to its reset pulse input terminal R, to generate an output of 1 through its output terminal Q0. The outputs through the output terminals Q0–Q3 of the ring counter 13 are applied to AND circuits 19*a*–19*d*.

The Me value counter 15 counts the number of clock pulses CP having a predetermined pulse repetition period, generated from a reference clock generator, not shown, between adjacent pulses of the TDC signal successively supplied to the Me value counter 15 from the waveform shaper 11*b*. Therefore, a count Me from the Me value counter 15 corresponds to the time interval between adjacent pulses of the TDC signal, that is, it is proportional to the reciprocal of the rotational speed Ne of the engine (1/Ne). An Me value register 16 is loaded with a count Me from the Me value counter 15 in synchronism with inputting of timing pulses thereto, and the loaded Me value is applied to the Ti value calculating circuit 14 as well as to a comparator 17.

The Ti value calculating circuit 14 operates on a signal indicative of the rotational speed Ne of the engine supplied from the Me value register 16 to calculate the fuel injection period (fuel quantity) Ti and supplies control pulses having a pulse duration corresponding to the calculated fuel injection period Ti to the AND circuits 19*a*–19*d* in synchronism with pulses of the TDC signal supplied from the waveform shaper 11*b*. These AND circuits 19*a*–19*d* transfer the control pulses supplied from the Ti value calculating circuit 14 to a driving circuit 20 as long as they are energized with pulses from the ring counter 13 which are successively applied to the AND circuits 19*a*–19*d* one after another.

The driving circuit 20 supplies driving pulses in a successive manner to respective fuel injection valves 3*a*–3*d* to energize same one after another, as long as it is supplied with successive control pulses from the AND circuits 19*a*–19*d*.

The comparator 17 determines whether or not the engine rotational speed Ne exceeds a predetermined low speed Ncp, e.g. 80 rpm. To be concrete, it compares a value Mecp indicative of the reciprocal of a predetermined engine rotational speed Ncp, supplied at its one input terminal B from an Mecp value memory 18 with a value Me corresponding to the actual engine rotational speed Ne supplied at its other input terminal A, and when the relationship Me<Mecp, i.e. Ne>Ncp stands, it generates an output of 1, which is applied to the aforementioned AND circuit 22.

On the other hand, a constant voltage-regulator circuit 27 is arranged for connection with a battery 25 upon turning-on or closing of the ignition switch 7 to generate a predetermined level of voltage Vcc. A trigger pulse generator circuit 28 is comprised of a resistance R1 and a capacitor C1 serially connected, a diode D1 connected in parallel with the resistance R1, and a Schmitt trigger circuit 29 with its input connected to the junction of the resistance R1 with the capacitor C1. Upon being supplied with the regulated output voltage Vcc from the constant voltage-regulator circuit 27, that is, when the ignition swicth 7 is turned on, the trigger pulse generator circuit 28 generates a trigger pulse Pt and applies same to the down counter 23 at its input terminal L by way of an OR circuit 30.

The down counter 23 is responsive to the trigger pulse Pt or a pulse of the CYL signal to be loaded with a predetermined value NCYL from a memory 24 which stores the value NCYL indicative of a predetermined number for abnormality detection. The value NCYL is set at a value equal to the sum of the number of the engine cylinders and 1 (e.g. 5). The AND circuit 22 is energized by an output of 1 from the comparator 17 which is generated when the relationship Ne<Ncp stands and accordingly the down counter 23 generates an output of 1. The energized AND circuit 22 transfers pulses of the TDC signal applied thereto, to the down counter 23 at its clock input terminal CK as long as it is energized. The count N, in the down counter 23 is reduced by 1 from its initial value or preset value NCYL each time a pulse of the TDC signal is applied thereto through the energized AND circuit 22, and when five such reductions are carried out, the count N is reduced to zero. The output from the down counter 23 assumes a value of 1 while its count is other than zero, and assumes a low level (hereinafter called "0") while its count is zero. As previously stated, each time a pulse of the CYL signal is applied to its input terminal L, the down counter 23 is loaded with the value NCYL from the NCYL value memory 24. Therefore, the output from the down counter 232 assumes a value of 1 if one pulse of the CYL signal is generated by the time a fifth pulse of the TDC signal is applied to the down counter 23, whereas the output assumes a value of 0 if no pulse of the CYL signal is applied to the counter 23 even after five pulses of the TDC signal have been generated. The CYL sensor 6 is regarded as abnormal when the output from the down counter 23 assumes a value of 0. When the output from the down counter 23 becomes 0, the AND circuits 12, 22 become deenegization. Deenegization of the AND circuit 12 impedes application of pulses of the CYL signal to the reset pulse input terminal R of the ring counter 13 to prevent the ring counter from being reset by a pulse of the CYL signal. Consequently, the ring counter 13 has its outputting sequence controlled by pulses of the TDC signal. To be concrete, as pulses of the TDC signal are successively applied to the ring counter 13, output pulses from the ring counter 13 are successively generated through different ones of the output terminals in the order of Q0, Q1, Q2, Q3, Q0, Q1 . . . On the other hand, deenergization of the AND circuit 22 prevents application of pulses of the TDC signal to the down counter 23.

In this way, abnormality of the cylinder-discriminating means, i.e. the CYL sensor 6 is detected, and when such abnormality is detected, the ring counter 13 is prevented from being reset by further pulses of the CYL signal which are generated in an irregular manner, while simultaneously the ring counter 13 is operated by pulses of the TDC signal alone so that the fuel injection valves 3*a*–3*d* are successively opened to inject fuel into the respective engine cylinders in a successive manner, e.g. in the order of first, third, fourth and second engine cylinders, in accordance with the predetermined sequence of outputting through the different output terminals of the ring counter 13.

Figure 4:
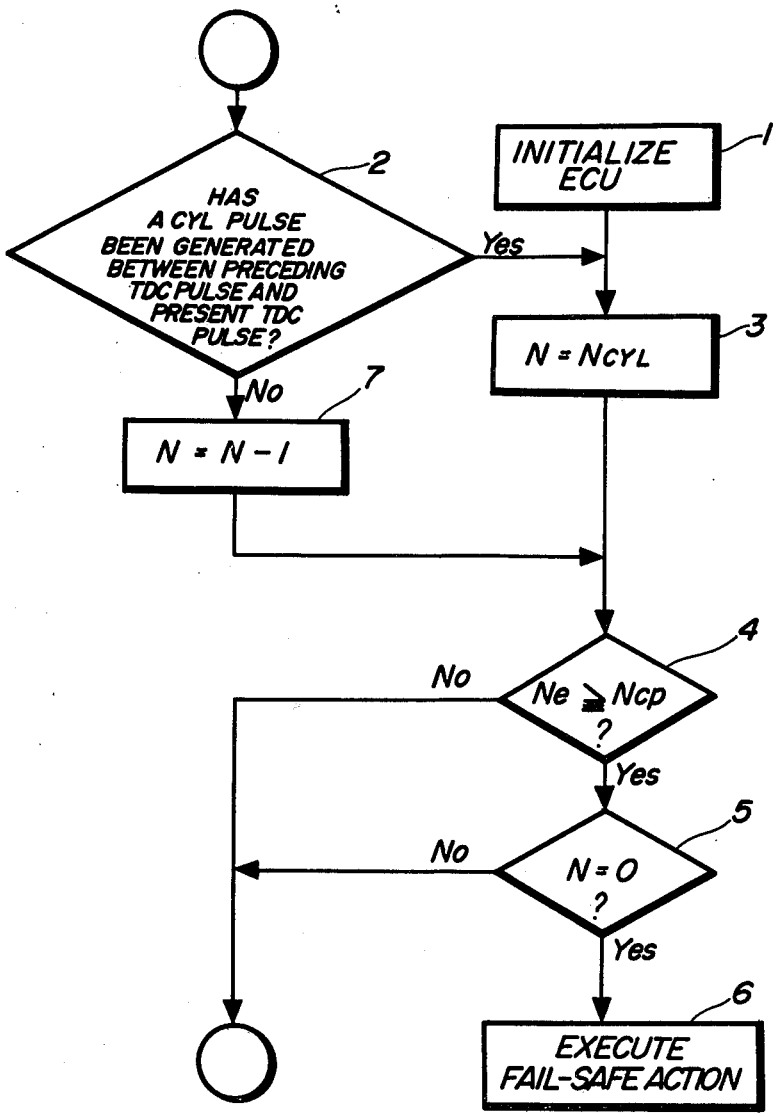
FIG. 4 is a flow chart of a manner of determining an abnormality in the cylinder-discriminating means, according to the method of the invention.

FIG. 4 shows a flow chart of a manner of detecting an abnormality in the cylinder-discriminating means, according to the method of the invention. The ECU 4 is initialized when the ignition switch 17 is closed, at the step 1. The count N of the down counter 23 in FIG. 3 is set to the preset value NCYL (=the number of engine cylinders plus 1), at the step 3. Next, the program proceeds to the step 4 to determine whether or not the engine rotational speed Ne is larger than the predetermined rpm Ncp. If the rotational speed Ne is determined to be lower than the predetermined rpm Ncp, execution of the program is terminated, because at such low engine speed, the CYL sensor 6 formed by an electromagnetic pickup is not excited by the salient pole 10*b* on the magnetic disc in FIG. 2 to such a sufficient extent as to ensure positive generation of pulses of the CYL signal. If the answer to the question of the step 4 is affirmative, it is then determined at the step 5 whether or not the count N of the down counter 23 is zero. Immediately after initialization of the ECU 4, the count N is set to the predetermined value NCYL at the step 3, and accordingly the answer to the question of the step 5 is negative. Therefore, on such occasion, the CYL sensor 6 is regarded as normal, and execution of the program is terminated.

The ECU 4 is initialized only when the ignition switch 7 is closed, and thereafter the steps 2 through 7 are executed in synchronism with generation of pulses of the TDC signal. After closing of the ignition switch 7, the step 2 is first executed each time a pulse of the TDC signal is generated. In the step 2, it is determined whether or not a pulse of the CYL signal has been generated between the time of generation of a preceding pulse of the TDC signal and the time of generation of the present pulse thereof. If no pulse of the CYL signal has is found to have been generated, the count N of the down counter 23 is reduced by 1, followed by execution of the step 4. If it is determined at the step 2 that a pulse of the CYL signal has been generated, the step 3 is executed to set the count N of the down counter 23 to the predetermined value NCYL, and then the program proceeds to the step 4. If there is not any abnormality in the CYL sensor 6, one pulse of the CYL signal is generated each time four pulses of the TDC signal are generated, and accordingly the count N of the down counter 23 is set to the predetermined value NCYL before it is reduced to zero at the step 7. Therefore, so far as the CYL sensor 6 is normal, the answer to the question of the step 5 is never affirmative, that is, the normality of the CYL sensot 6 is never negated.

On the other hand, when an abnormality occurs in the CYL sensor 6 so that no pulse of the CYL signal is generated, the count N of the down counter 23 is not set to the predetermined value NCYL, and consequently the count N is reduced to zero at the step 7 after five pulses of the TDC signal (=the number of engine cylinders plus 1) have been generated, to provide an affirmative answer to the question of the step 5. That is, the CYL sensor 6 is then regarded as abnormal to cause execution of the step 6 to perform a fail safe action.

The fail safe action comprises, by way of example, deenergizing the AND circuits 12, 22 to prohibit resetting of the ring count 13 by a pulse of the CYL signal, as well as the loading action of the down counter 23 to impede application of pulses of the TDC signal to the down counter 23. As a consequence, the ring counter 13 operates only on pulses of the TDC signal so that it succssively generates output pulses through its different output terminals in the order of Q0, Q1, Q2, Q3, Q0 . . . as pulses of the TDC signal are successively applied to the ring counter 13. In this way, when the CYL sensor is determined to be abnormal, the sequence of fuel injections is determined by generation of pulses of the TDC signal in lieu of pulses of the CYL signal, and the engine cylinders are each supplied with a batch of injected fuel during each cycle of the engine, though the injection timing can be slightly deviated from optimum timing, thereby at least ensuring continuation of the operation of the engine.

What is claimed is:

1. A method for controlling the injection of fuel into an internal combustion engine having a plurality of cylinders, pistons diposed within respective ones of said cylinders, a crankshaft to which said pistons are connected, top-dead-center detecting means for detecting predetermined positions of said pistons within said respective ones of said cylinders relative to top dead centers thereof and generating pulses indicative of detected predetermined positions of said pistons, and cylinder-discriminating means adapted to generate a pulse each time said crankshaft of said engine rotates through a predetermined angle with respect to a predetermined position of one of said pistons which is disposed within a particular one of said cylinders, wherein fuel is injected into said cylinders of said engine successively in predetermined sequence in synchronism with pulses successively generated from said top-dead-center detecting means immediately after generation of each pulse of said cylinder-discriminating means, the method comprising the steps of: (1) detecting pulses generated from said cylinder-discriminating means; (2) counting the number of pulses successively generated from said top-dead-center detecting means immediately after generation of each pulse from said cylinder-discriminating means; (3) detecting the rotational speed of said engine; (4) regarding said cylinder-discriminating means as abnormal when no further pulse from said cylinder-discriminating means is detected after detection of each pulse generated from said cylinder-discriminating means until the counted number of pulses generated from said top-dead-center detecting means reaches a number equal to the sum of the number of said cylinders of said engine and 1 while the rotational speed of said engine is higher than a predetermined value; and (5) effecting injection of fuel into said cylinders in said predetermined sequence in synchronism with pulses generated from said top-dead-center detecting means alone, irrespective of generation of subsequent pulses from said cylinder-discriminating means, when said cylinder-discriminating means is regarded as abnormal in said step (4).

* * * * *